US007812701B2

(12) United States Patent
Lee et al.

(10) Patent No.: US 7,812,701 B2
(45) Date of Patent: Oct. 12, 2010

(54) COMPACT MULTIPLE TRANSFORMERS

(75) Inventors: Dong Ho Lee, Atlanta, GA (US); Ki Seok Yang, Atlanta, GA (US); Chang-Ho Lee, Marietta, GA (US); Haksun Kim, Daejeon (KR); Joy Laskar, Marietta, GA (US)

(73) Assignees: Samsung Electro-Mechanics (KR); Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 11/970,995

(22) Filed: Jan. 8, 2008

(65) Prior Publication Data

US 2009/0174515 A1 Jul. 9, 2009

(51) Int. Cl.
*H01F 5/00* (2006.01)

(52) U.S. Cl. ..... 336/200

(58) Field of Classification Search ..... 336/150, 336/170, 180–184, 192, 200, 220–223, 232
See application file for complete search history.

(56) References Cited

U.S. PATENT DOCUMENTS

| | | | | |
|---|---|---|---|---|
| 2,710,312 | A | 6/1955 | Hafler et al. | |
| 3,060,266 | A | 10/1962 | Dow | |
| 4,105,941 | A | 8/1978 | Routh | |
| 4,994,760 | A | 2/1991 | Roehrs | |
| 5,091,703 | A | 2/1992 | Schenk | |
| 5,543,773 | A | 8/1996 | Evans et al. | |
| 5,796,165 | A | 8/1998 | Yoshikawa et al. | |
| 6,097,273 | A | 8/2000 | Frye et al. | |
| 6,323,686 | B1 | 11/2001 | Bisson et al. | |
| 6,396,362 | B1 * | 5/2002 | Mourant et al. | 333/25 |

(Continued)

FOREIGN PATENT DOCUMENTS

| | | | |
|---|---|---|---|
| EP | 1677415 | A1 | 5/2006 |

(Continued)

OTHER PUBLICATIONS

Combined Search Report and Examination Report issued May 1, 2009 for GB Patent Application No. 0900056.3.

(Continued)

*Primary Examiner*—Tuyen Nguyen
(74) *Attorney, Agent, or Firm*—Sutherland Asbill & Brennan LLP

(57) ABSTRACT

Example embodiments of the invention may provide systems and methods for multiple transformers. The systems and methods may include a first transformer that may include a first primary winding and a first secondary winding, where the first primary winding may be inductively coupled to the first secondary winding, where the first transformer may be associated with a first rotational current flow direction in the first primary winding. The systems and methods may further include a second transformer that may include a second primary winding and a second secondary winding, where the second primary winding may be inductively coupled to the second secondary winding, where the second transformer may be associated with a second rotational current flow direction opposite the first rotational current flow direction in the second primary winding, where a first section of the first primary winding may be positioned adjacent to a second section of the second primary winding, and where the adjacent first and second sections may include a substantially same first linear current flow direction.

20 Claims, 9 Drawing Sheets

U.S. PATENT DOCUMENTS

| | | | | |
|---|---|---|---|---|
| 6,466,094 | B2 | 10/2002 | Leighton et al. | |
| 6,476,704 | B2 | 11/2002 | Goff | |
| 6,577,219 | B2 | 6/2003 | Visser | |
| 6,614,308 | B2 | 9/2003 | Moller et al. | |
| 6,674,632 | B2 | 1/2004 | Kiewitt et al. | |
| 6,731,166 | B1 | 5/2004 | Sabouri et al. | |
| 6,737,916 | B2 | 5/2004 | Luu | |
| 6,798,295 | B2 | 9/2004 | Pengelly et al. | |
| 6,818,979 | B2 | 11/2004 | Takehara et al. | |
| 6,882,263 | B2 | 4/2005 | Yang et al. | |
| 6,885,275 | B1 | 4/2005 | Chang | |
| 7,061,329 | B2 | 6/2006 | Inoue et al. | |
| 7,091,791 | B1 | 8/2006 | Terrovitis | |
| 7,091,813 | B2 * | 8/2006 | Liang et al. | 336/200 |
| 7,092,678 | B2 | 8/2006 | Shih | |
| 7,129,784 | B2 | 10/2006 | Bhatti et al. | |
| 7,157,965 | B1 | 1/2007 | Kim | |
| 7,176,579 | B2 | 2/2007 | Konishi et al. | |
| 7,192,788 | B2 | 3/2007 | Kurokawa | |
| 7,242,245 | B2 | 7/2007 | Burns et al. | |
| 7,260,152 | B2 * | 8/2007 | Golo | 375/257 |
| 7,276,420 | B2 | 10/2007 | Liu et al. | |
| 7,348,656 | B2 | 3/2008 | Briere | |
| 7,365,602 | B2 | 4/2008 | Bhatti et al. | |
| 7,414,507 | B2 * | 8/2008 | Giandalia et al. | 336/200 |
| 7,425,869 | B2 | 9/2008 | Aoki et al. | |
| 7,288,995 | B2 | 10/2008 | Vaisanen | |
| 7,486,167 | B2 | 2/2009 | Loke et al. | |
| 2006/0284685 | A1 | 12/2006 | Vaisanen | |
| 2007/0046371 | A1 | 3/2007 | Barabash et al. | |
| 2007/0069717 | A1 | 3/2007 | Cheung et al. | |
| 2008/0164941 | A1 | 7/2008 | Lee et al. | |
| 2008/0284553 | A1 | 11/2008 | Lim et al. | |

FOREIGN PATENT DOCUMENTS

| | | | |
|---|---|---|---|
| GB | 2269057 | A | 1/1994 |
| GB | 2445677 | A | 7/2008 |
| JP | 2003506915 | A | 2/2003 |
| WO | WO 0110053 | A1 | 2/2001 |

OTHER PUBLICATIONS

Combined Search and Examination Report dated Apr. 30, 2009 for Application No. GB0823679.6.

Search Report dated Mar. 18, 2008 for GB0800400.4.

Notice of Allowance dated Jul. 13, 2009 for U.S. Appl. No. 11/968,862.

Notice of Allowance dated Mar. 9, 2009 for U.S. Appl. No. 11/968,862.

Notice of Allowance dated Mar. 22, 2010 for U.S. Appl. No. 12/138,188.

Non-Final Office Action dated Sep. 11, 2009 for U.S. Appl. No. 12/138,188.

Notice of Allowance dated Dec. 1, 2009 for U.S. Appl. No. 11/964,646.

Non-Final Office Action dated Aug. 21, 2009 for U.S. Appl. No. 11/964,646.

Non-Final Office Action dated Feb. 27, 2009 for U.S. Appl. No. 11/964,646.

Non-Final Office Action dated Dec. 31, 2009 for U.S. Appl. No. 12/416,268.

* cited by examiner

COMPACT MULTIPLE TRANSFORMERS

FIELD OF INVENTION

The invention relates generally to transformers, and more particularly, to systems and methods for compact multiple transformers.

BACKGROUND OF THE INVENTION

According to the fast growth of semiconductor technology, many blocks and functions have been integrated on a chip as a System-On-Chip (SOC) technology. In the semiconductor technology, a monolithic transformer requires a significant amount of space. Moreover, the monolithic transformer requires a minimum of 50-μm spacing from other circuitry to prevent undesirable magnetic coupling or loss of magnetic flux. Accordingly, the total size of multiple transformers is large and increases manufacturing cost, chip size, and package size.

BRIEF SUMMARY OF THE INVENTION

Example embodiments of the invention may provide for compact multiple transformers, where each transformer of the multiple transformers may include a primary winding and a secondary winding. A first transformer may be coupled to at least one other second transformer, where the first outer metal lines of the first transformer may be coupled to the second outer metal lines of the at least one other second transformer, where the first outer metal lines and the second outer metal lines may provide for a same current flow direction. The same current flow direction may increase magnetic flux, inductance, and/or quality factor of the transformers.

According to an example embodiment of the invention, there may be system for multiple transformers. The system may include a first transformer that may include a first primary winding and a first secondary winding, where the first primary winding may be inductively coupled to the first secondary winding, where the first transformer may be associated with a first rotational current flow direction in the first primary winding. The system may also include a second transformer that may include a second primary winding and a second secondary winding, where the second primary winding may be inductively coupled to the second secondary winding, where the second transformer may be associated with a second rotational current flow direction opposite the first rotational current flow direction in the second primary winding, where a first section of the first primary winding may be positioned adjacent to a second section of the second primary winding, wherein the adjacent first and second sections may include a substantially same first linear current flow direction.

According to another example embodiment of the invention, there may be a method for providing multiple transformers. The method may include providing a first transformer that may include a first primary winding and a first secondary winding, where the first primary winding may be inductively coupled to the first secondary winding, wherein the first primary winding is coupled to first input ports, and receiving a first input source at the first input ports to provide a first rotational current flow direction in the first primary winding. The method may also include providing a second transformer that may include a second primary winding and a second secondary winding, where the second primary winding may be inductively coupled to the second secondary winding, where the second primary winding may be coupled to second input ports, and receiving a second input source at the second input ports to provide a second rotational current flow direction opposite the first rotational current flow direction in the second primary winding. A first section of the first primary winding may be positioned adjacent to a second section of the second primary winding, where the adjacent first and second sections include a substantially same linear current flow direction.

BRIEF DESCRIPTION OF THE DRAWINGS

Figure 1A:
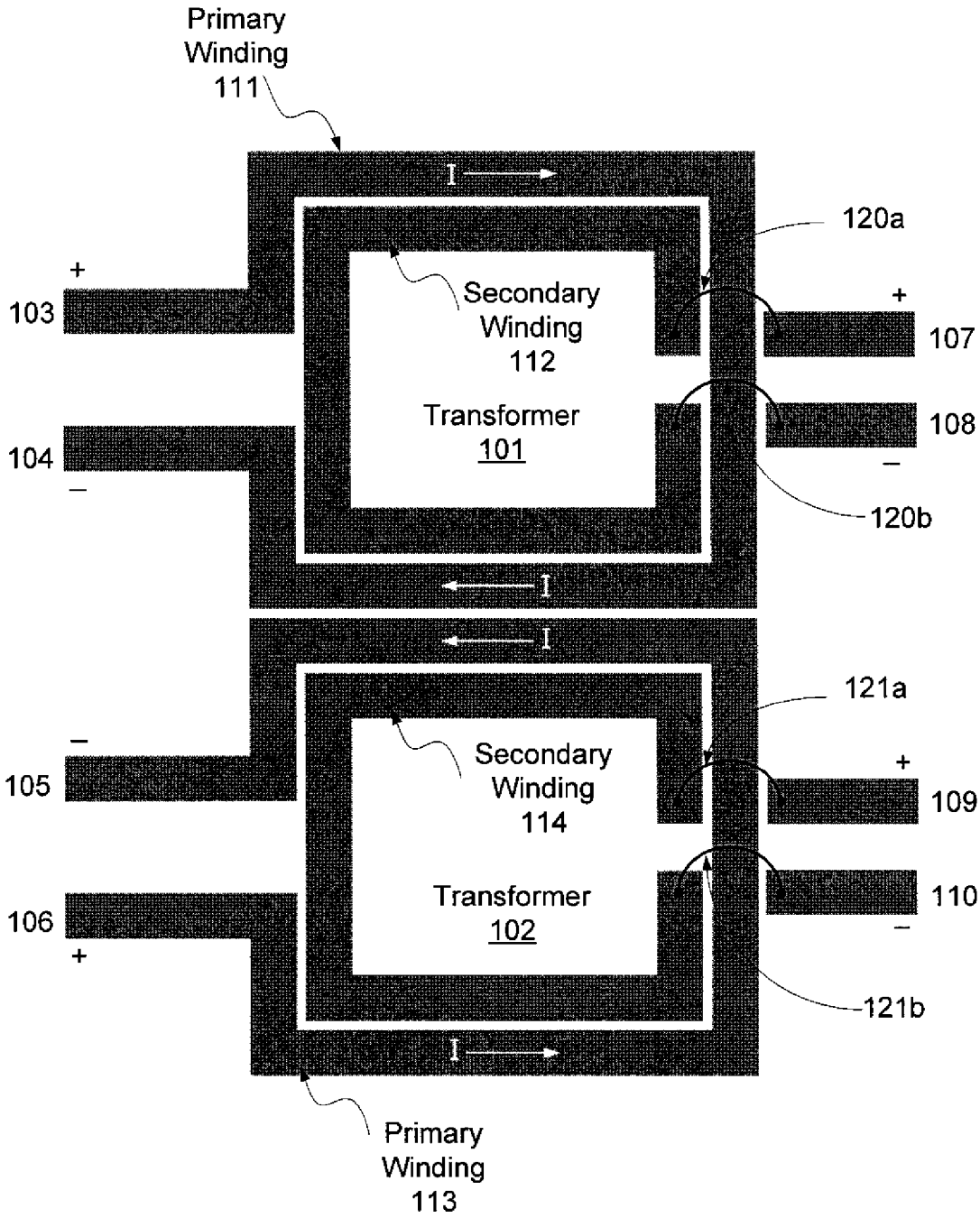
Figure 1B:
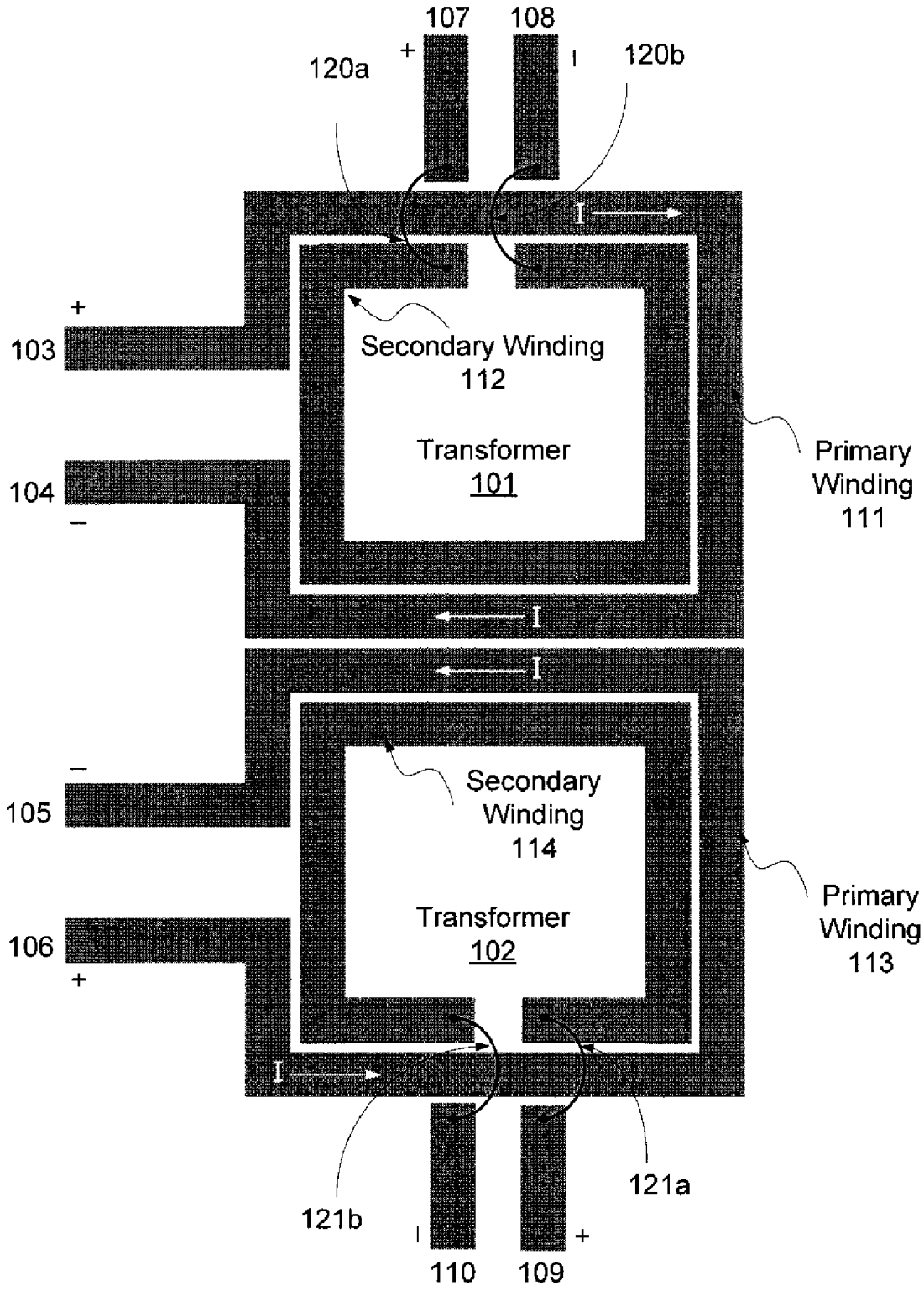
Figure 1C:
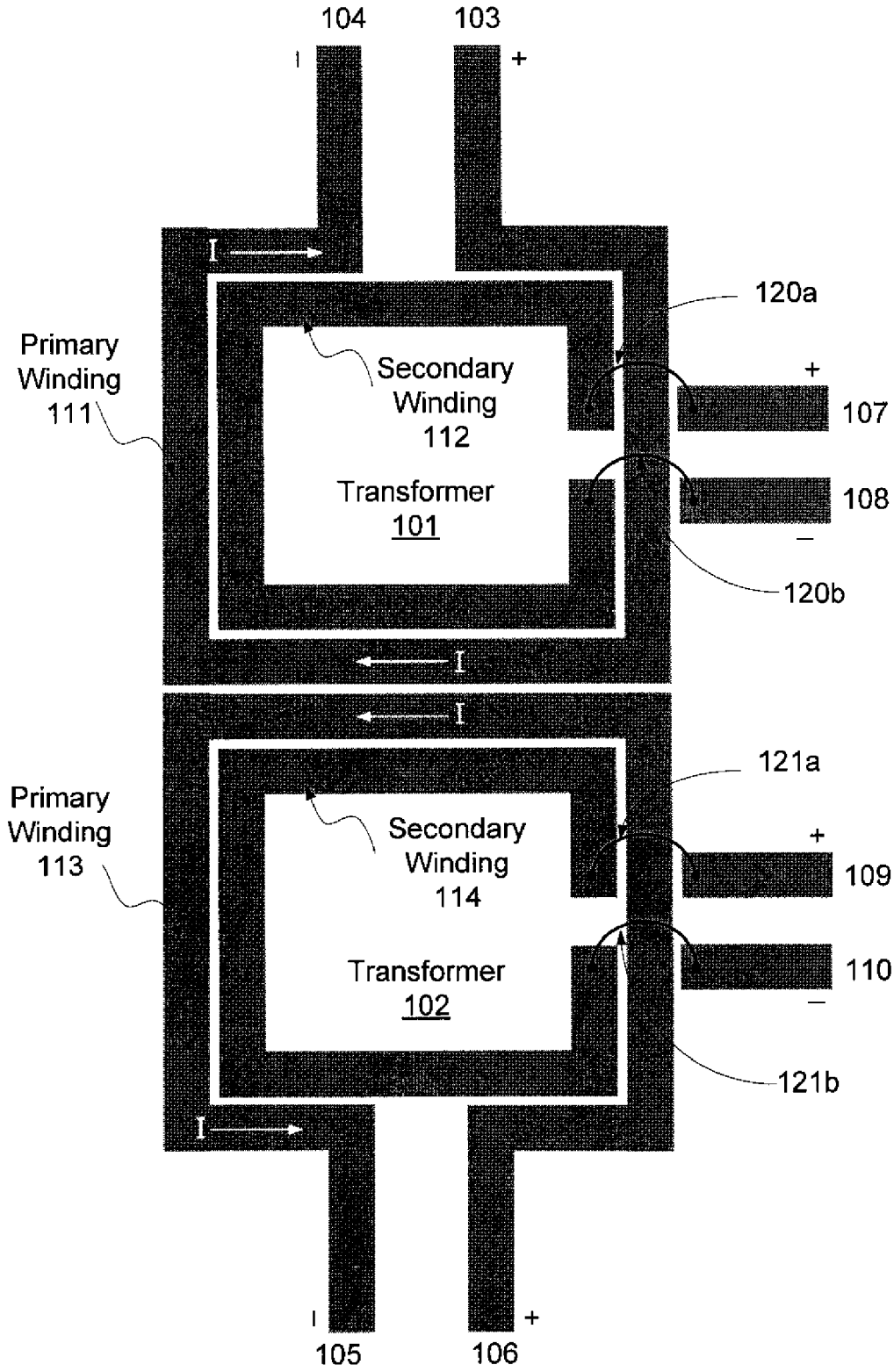

Having thus described the invention in general terms, reference will now be made to the accompanying drawings, which are not necessarily drawn to scale, and wherein:

FIGS. 1A-1C illustrates example compact multiple transformers, according to an example embodiments of the invention.

Figure 2:
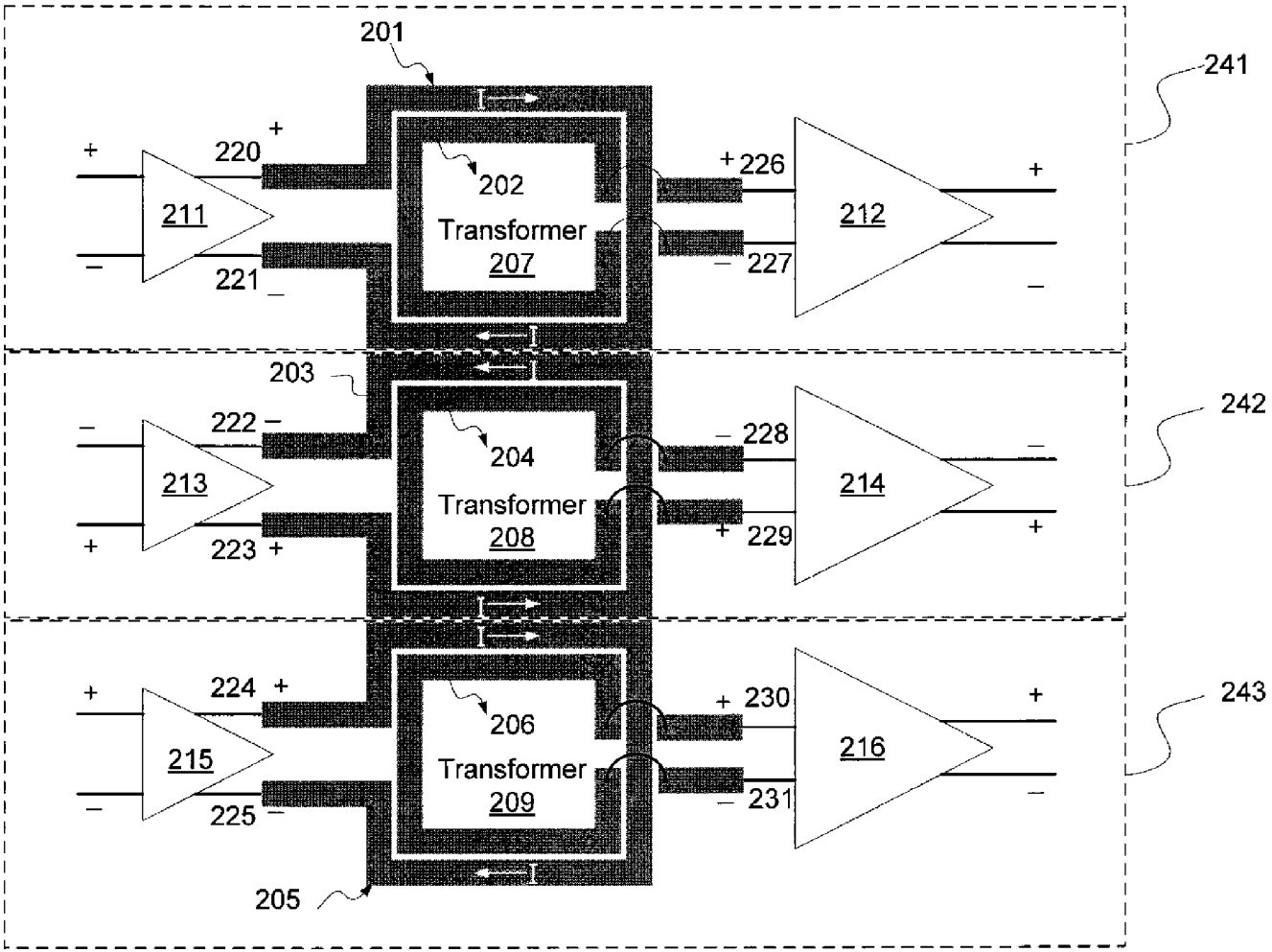

FIG. 2 illustrates an example compact multiple transformers application for parallel inter-stage networks using multiple transformers, according to an example embodiment of the invention.

Figure 3:
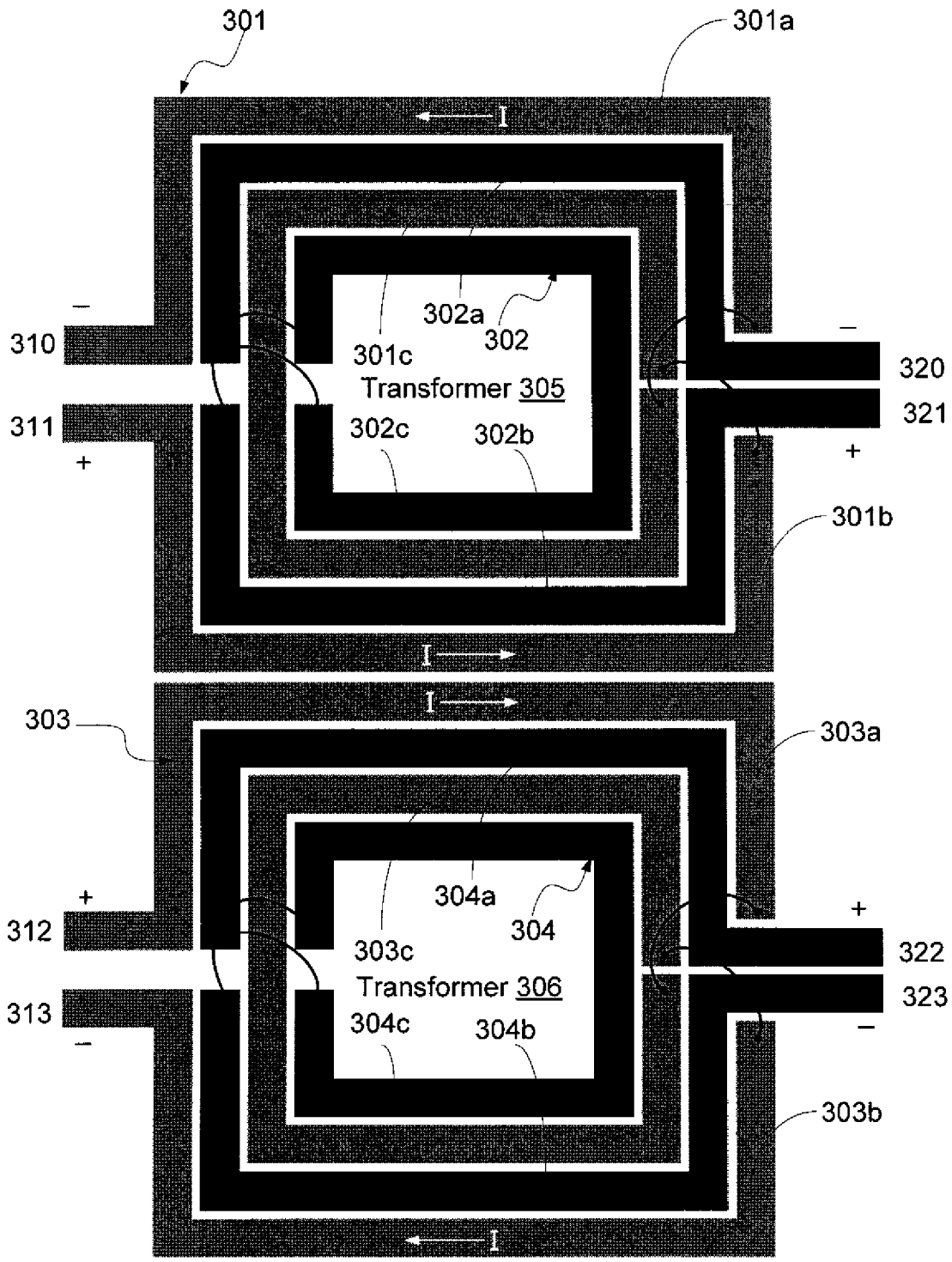

FIG. 3 illustrates example compact multiple transformers having one or more windings with multiple turns, according to an example embodiment of the invention.

Figure 4:
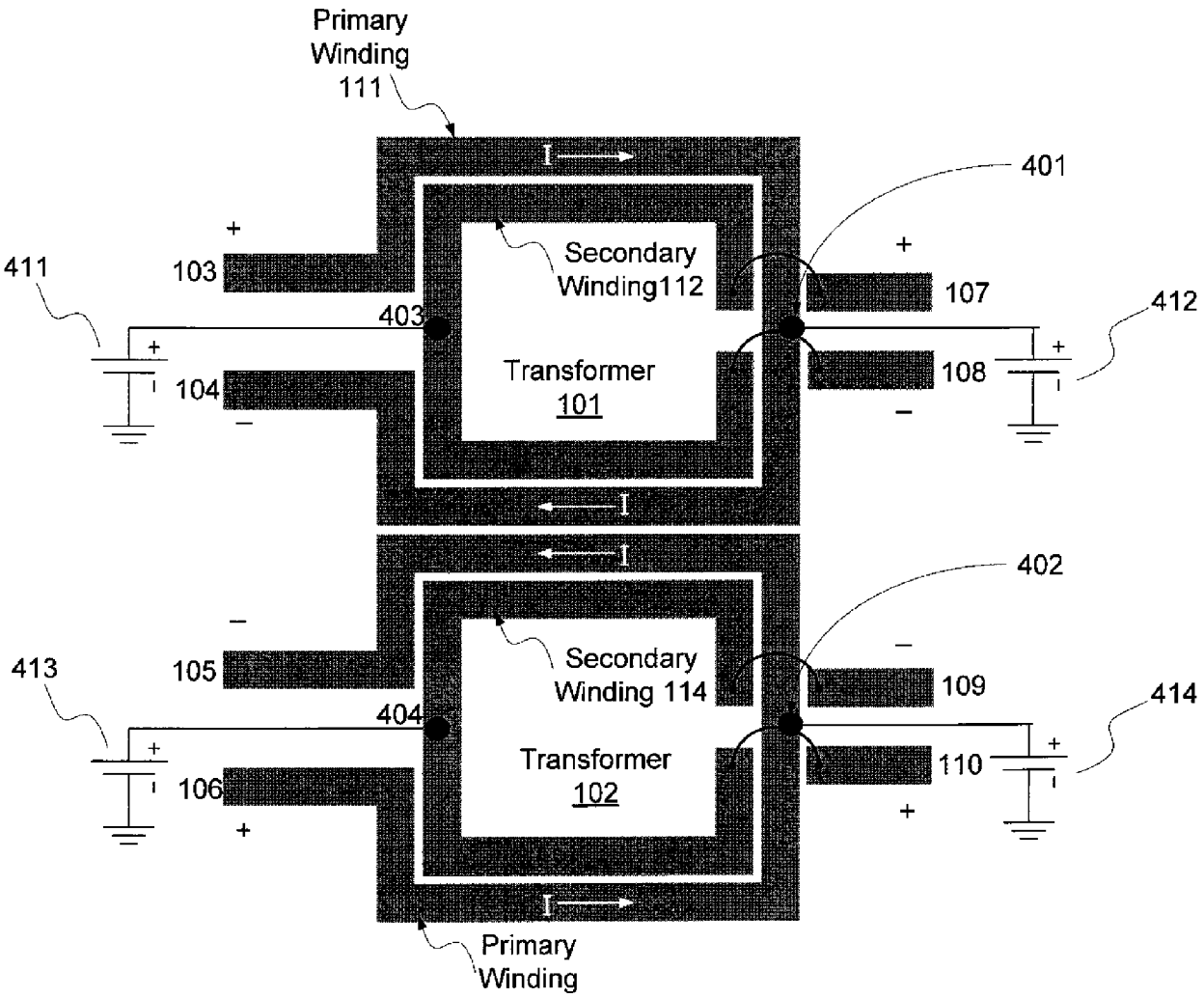

FIG. 4 illustrates example compact multiple transformers with DC biasing through center taps, according to an example embodiment of the invention.

Figure 5:
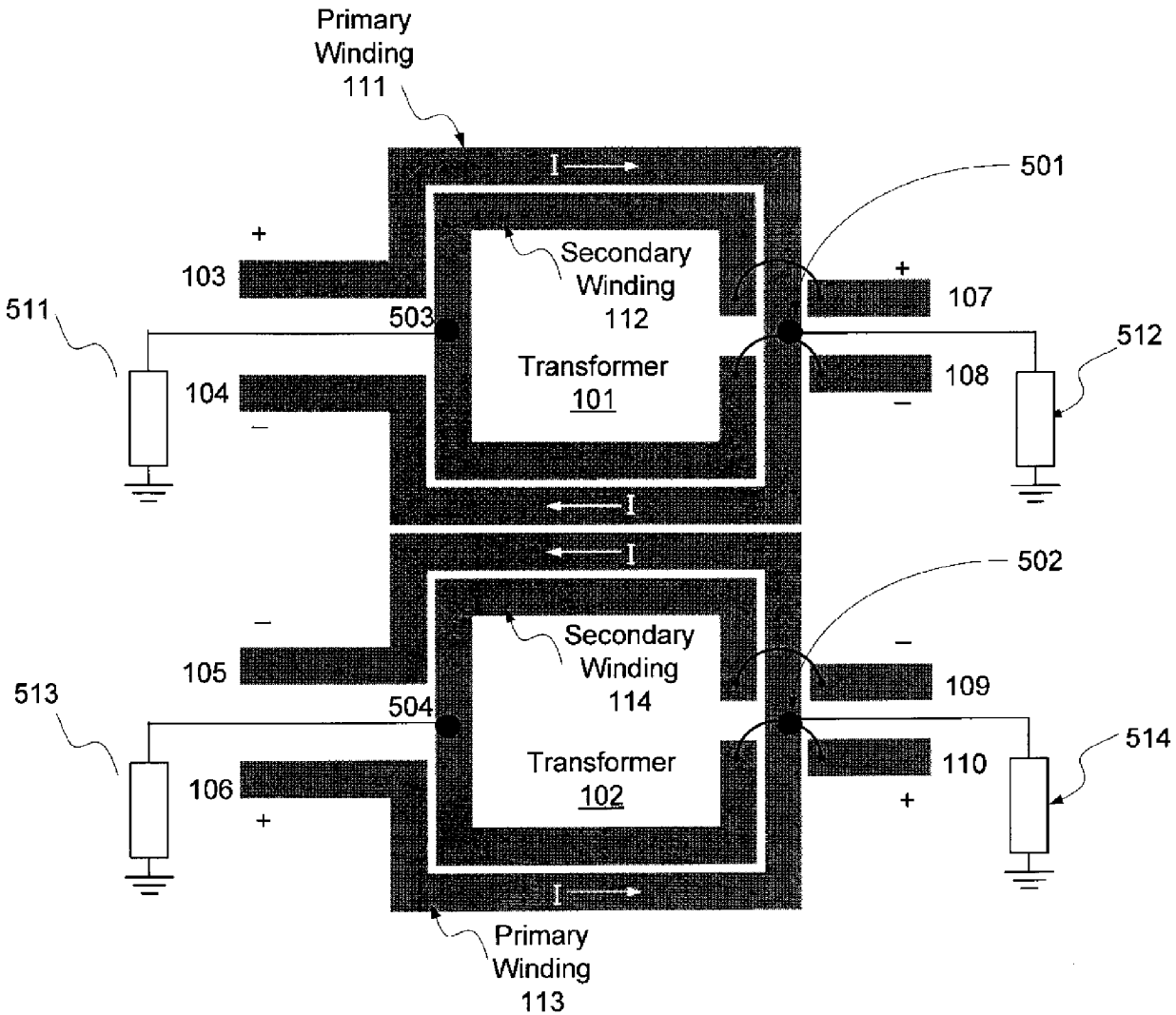

FIG. 5 illustrates example compact multiple transformers with tuning blocks through center taps, according to an example embodiment of the invention.

Figure 6C:
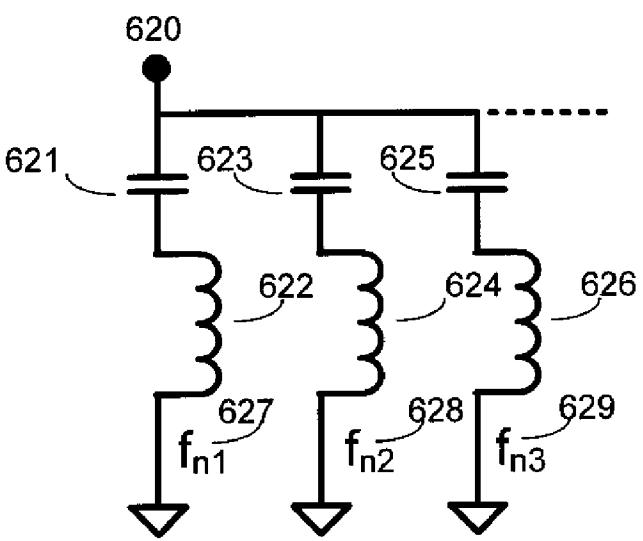
Figure 6B:
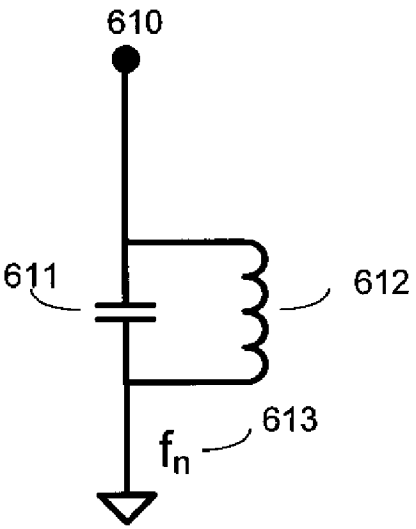
Figure 6A:
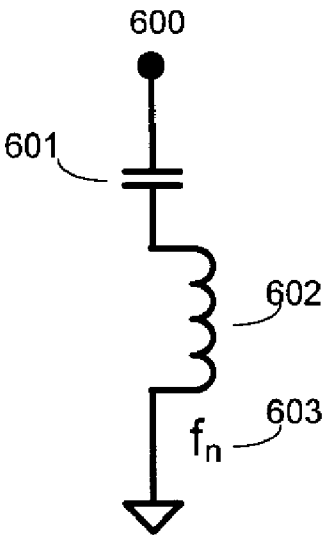

FIG. 6A-6C illustrate example schematic diagrams of example tuning blocks in accordance with example embodiments of the invention.

Figure 7:
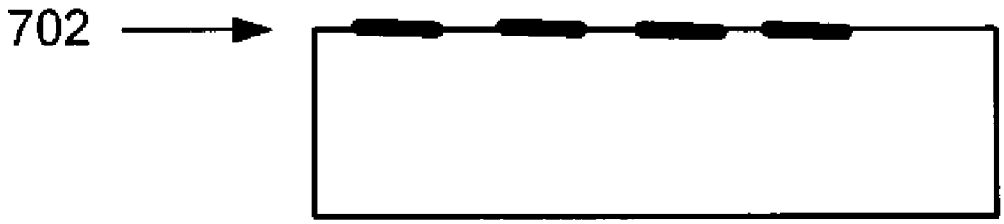

FIG. 7 illustrates an example planar structure for implementing the multiple transformers, according to an example embodiment of the invention.

Figure 8:
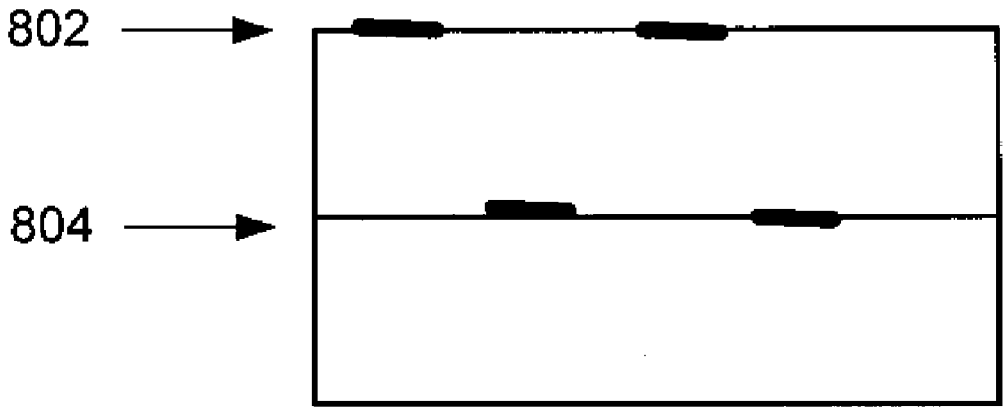

FIG. 8 illustrates an example stacked structure for implementing the multiple transformers, according to an example embodiment of the invention.

DETAILED DESCRIPTION OF THE INVENTION

Example embodiments of the invention now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1A illustrates example compact multiple transformers, including a first transformer 101 and a second transformer 102, according to an example embodiment of the invention. As shown in FIG. 1A, the example compact multiple transformers may include a first transformer 101 that includes a primary winding 111 and a secondary winding 112. The primary winding 111 may receive input signals from a first input port 103 that may receive a positive input signal and a second input port 104 that may receive a negative input signal. According to an example embodiment of the invention, the primary winding 111 may be inductively coupled to the secondary winding 112. The secondary winding 112 may provide output signals to a first output port 107 providing a positive output signal and a second output port 108 providing a negative output signal. As shown in FIG. 1A, the outer primary winding 111 may encapsulate or surround one or more portions of the inner secondary winding 112. One or more wire-bond, via, or other electrical connections 120*a*, 120*b* may be used to route the output ports 107, 108 of the secondary winding 112 around the primary winding 111. For example, connection 120*a* may be used to electrically connect a first portion of the secondary winding 112 to the first output port 107, and connection 120*b* may be used to electrically connect a second portion of the secondary winding 112 to the second output port 108.

Similarly, the example compact multiple transformers of FIG. 1A may also include a second transformer 102 that may include a primary winding 113 and a secondary winding 114. The primary winding 113 may receive input signals from a first input port 105 that may receive a negative input signal and a second input port 106 that may receive a positive input signal. According to an example embodiment of the invention, the primary winding 113 may be inductively coupled to the secondary winding 114. The secondary winding 114 may provide output signals to a first output port 109 providing a positive signal output and a second output port 110 providing a negative signal output. As shown in FIG. 1A, the outer primary winding 113 may encapsulate or surround one or more portions of the inner secondary winding 114. One or more wire-bond, via, or other electrical connections 121*a*, 121*b* may be used to route the output ports 109, 110 of the secondary winding 114 around the primary winding 113. For example, connection 121*a* may be used to electrically connect a first portion of the secondary winding 114 to the first output port 109, and connection 121*b* may be used to electrically connect a second portion of the secondary winding 114 to the second output port 110.

According to an example embodiment of the invention, the first transformer 101 and the second transformer 102 may be spiral-type transformers, although other types of transformers may be utilized as well. It will also be appreciated that the primary windings 111, 113 and the secondary windings 112, 114 may be fabricated or otherwise patterned as conductive lines or traces using one or more metal layers provided on one or more semiconductor substrates. As an example, the metal layers may be comprised of copper, gold, silver, aluminum, nickel, a combination thereof, or yet other conductors, metals, and alloys, according to an example embodiment of the invention. According to an example embodiment of the invention, the transformers 101, 102 may be fabricated with other devices on the same substrate. For example, transistors, inductors, capacitors, resistors, and transmission lines may be fabricated with the transformers 101, 102 on the same substrate.

In FIG. 1A, the first transformer 101 and the second transformer 102 may be placed adjacent to each other according to a compact layout, according to an example embodiment of the invention. For example, a first section (e.g., a bottom section) of the primary winding 111 may be placed adjacent to a second section (e.g., a top section) of the primary winding 113 with a small separation distance. According to an example embodiment of the invention, the separation distance between the first section of the primary winding 111 and the adjacent second section of the primary winding 113 may be less than 50 μm, perhaps in the range of minimum spacing to 15 μm (e.g., perhaps 0.01-6 μm) for a highly compact layout or in the range of 15-30 μm (e.g., perhaps 12-14 μm) for a slightly less compact layout. Other spacing ranges may also be utilized without departing from example embodiments of the invention.

As shown in FIG. 1A, when the bottom section of the primary winding 111 is adjacent to the top section of the primary winding 113, the linear direction of the current flow through the adjacent primary winding sections may be provided in the same linear direction in order to magnetically couple the first transformer 101 to the second transformer 102 through the adjacent primary winding sections. In order for the adjacent primary winding sections to have the substantially the same linear current flow direction, the rotational current flow in the primary winding 111 may be provided in a first rotational direction while the rotational current flow in the primary winding 113 may be provided in a second rotational direction that is different from or opposite the first rotational direction. For example, by providing the primary winding 111 with a clockwise rotational current flow direction, the linear current flow in the bottom section of the primary winding 111 may be a right-to-left linear current flow direction. The adjacent top section of the primary winding 113 may likewise be provided with a right-to-left linear current flow direction by providing the primary winding 113 with a counterclockwise rotational current flow direction.

To provide the primary winding 111 with the clockwise rotational current flow direction, the first input port 103 may be provided with a positive input signal and the second input port 104 may be provided with a negative input signal, according to an example embodiment of the invention. On the other hand, to provide the primary winding 105 with the counterclockwise rotational current flow direction, the first input port 105 may be provided with a negative input signal and the second input port 106 may be provided with a positive input signal, according to an example embodiment of the invention.

In FIG. 1A, both the input ports 103, 104 for the first transformer 101 as well as the input ports 105, 106 for the second transformer 102 may be located on a left side of a compact layout according to an example embodiment of the invention. The output ports 107, 108 for the first transformer 101 as well as the output ports 109, 110 for the second transformer 102 may be located on a right side of the compact layout, according to an example embodiment of the invention. However, it will be appreciated that the locations of the input ports and output ports may also be a varied or otherwise reassigned according to an example embodiment of the invention. For example, the input ports of the transformers may be reassigned to provide the same current flow direction of the adjacent outer sections of the primary windings. Likewise, the output ports of transformers may be reassigned to provide the same current flow direction of the adjacent outer sections of the primary windings.

As an example, FIG. 1B illustrates a compact layout where the input ports 107, 108 for the first transformer 101 and the input ports 109, 110 for the second transformer 102 may be provided on a left side of the respective transformers 101, 102. However, the output ports 107, 108 for the first transformer 101 may be relocated to a top side of the first transformer 101 while the output ports 109, 110 for the second transformer 102 may be relocated to a bottom side of the second transformer 102. As another example, FIG. 1C illustrates a compact layout where the input ports 103, 104 for the first transformer 101 may be provided on a top side of the first transformer 101 while the input ports 105, 106 may be provided on a bottom side of the second transformer 102. The output ports 107, 108 for the first transformer 101 as well as the output ports 109, 110 may be placed on a right side of the respective transformers 101, 102. It will be the input ports and the output ports may be reassigned to various other locations without departing from example embodiments of the invention.

According to an example embodiment of the invention, the first and second transformers 101, 102 may have substantially symmetrical or mirrored structures. The symmetrical or mirrored structures may provide for good balancing of signals, according to an example embodiment of the invention. In an example embodiment of the invention, the line of symmetry may be defined according to a line between the adjacent sections of the first transformers 101, 102.

FIG. 2 illustrates an example application for compact multiple transformers, according to an example embodiment of the invention. In FIG. 2, there may be a plurality of amplifier blocks 241, 242, 243. According to an example embodiment of the invention, the amplifiers blocks 241, 242, 243 may be provided as parallel blocks.

The first amplifier block 241 may include a first-stage amplifier 211, a transformer 207, and a second-stage amplifier 212, according to an example embodiment of the invention. Likewise, the amplifier block 242 may include a first-stage amplifier 213, a transformer 208, and a second-stage amplifier 214, according to an example embodiment of the invention. The amplifier block 243 may include a first-stage amplifier 215, a transformer 209, and a second-stage amplifier 216. According to an example embodiment of the invention, the transformers 207, 208, 209 may be operative for inter-stage matching between a first and second electronic circuit blocks or first and second RF circuit blocks. For example, the transformers 207, 208, 209 may be operative for inter-stage matching between the respective first-stage amplifier 211, 213, 215 and the respective second-stage amplifier 212, 214, 216, according to an example embodiment of the invention.

In FIG. 2, the first transformer 207 may be comprised of a primary winding 201 that encapsulates or surrounds one or more sections of the secondary winding 202. The second transformer 208 may be comprised of a primary winding 203 that encapsulates or surrounds one or more sections of the secondary winding 204. Likewise, the third transformer 209 may be comprised of a primary winding 205 that encapsulates or surrounds one or more sections of the secondary winding 206.

As shown in FIG. 2, the transformers 207, 208, 209 may be positioned according using compact layout in which the first transformer 207 and the third transformer 209 may sandwich the second transformer 208. According to an example embodiment of the invention, the separation distance between the adjacent sections of the primary windings 201, 203, 205 may be minimized to provide the compact layout. For example, the separation distance between adjacent sections of primary windings 201, 203, 205 may be less than 50 μm, perhaps in the range of minimum spacing to 15 μm (e.g., perhaps 0.01-6 μm) for a highly compact layout or in the range of 15-30 μm (e.g., perhaps 12-14 μm) for a slightly less compact layout. Other spacing ranges may also be utilized without departing from example embodiments of the invention.

In FIG. 2, the bottom section of the first primary winding 201 may have the same linear current flow direction (e.g., right-to-left current flow) as the top section of the second primary winding 203. Thus, the bottom section of the first primary winding 201 may be magnetically coupled to the top section of the second primary winding 203, according to an example embodiment of the invention. Similarly, the bottom section of the second primary winding 208 may have the same linear current flow direction (e.g., left-to-right current flow) as the top section of the third primary winding 205. Accordingly, the bottom section of the second primary winding 203 may be magnetically coupled to the top section of the third primary winding 205.

As discussed above, the primary winding 203 of the second transformer 208 may be magnetically coupled to both the first and third transformers 207, 209. However, to do so, the primary winding 203 of the second transformer may be provided with a first rotational current flow direction while the primary windings 201, 205 of the first and third transformers 207, 209 may be provided with a second rotational current flow direction different from or opposite the first rotational current flow direction. For example, the second primary winding 203 may be provided with a counterclockwise rotational current flow direction, thereby providing for a right-to-left linear current flow direction in its top section and a left-to-right linear current flow in its bottom section, according to an example embodiment of the invention. On the other hand, the first and third primary windings 201, 205 may be provided with a clockwise rotational current flow direction, thereby providing for a left-to-right linear current flow direction in their respective top sections and a right-to-left linear current flow direction in their respective bottom sections.

It will be appreciated that in order to provide the second primary winding 203 with first rotational current flow direction (e.g., counterclockwise), the first input port 222 may be connected to a negative input signal while the second input port 223 may be connected a positive input signal. On the other hand, the first input ports 220, 224 and the second input ports 221, 225 for the first and third primary windings 201, 205 may be connected with an opposite polarities than that for the second primary winding 203. For example, the first input ports 220, 224 may be connected to a positive input signal while the second input ports 221, 225 may be connected to a negative input signal. According to an example embodiment of the invention, the first-stage amplifiers 211, 213, 215 may be connected such as to provide the required negative or positive input signals to the respective first input ports 220, 222, 224 and second input ports 221, 223, 225.

Still referring to FIG. 2, the first output port 228 for the second transformer 208 may be provided with a negative output signal while the second output port 229 may be provided with a positive output signal, according to an example embodiment of the invention. On the other hand, the first output ports 226, 230 for the first and third transformers 207, 209 may be provided with a positive output signal while the second output ports 227, 231 may be provided with a negative output signal, according to an example embodiment of the invention. The second-stage amplifiers 212, 214, 216 may receive the negative or positive output signals from the respective first output ports 226, 228, 230 and second output ports 227, 229, 231. Thus, it will be appreciated that the input and output ports of the amplifiers may be reassigned according to current flow direction desired by the transformers, according to an example embodiment of the invention.

FIG. 3 illustrates example compact multiple transformers with multi-turn windings, according to an example embodiment of the invention. In particular, FIG. 3 illustrates a first transformer 305 and a second transformer 306. The first transformer 305 may include a primary multi-turn winding 301 (e.g., 2 or more turns) and a secondary multi-turn winding 302 (e.g., 2 or more turns), according to an example embodiment of the invention. The primary multi-turn winding 301 may include a plurality of inner and outer sections 301*a-c* that may be connected by one or more wire-bond, via, or other electrical connections, according to an example embodiment of the invention. The secondary multi-turn winding 302 may include a plurality of inner and outer sections 302*a-c* that may be connected by one or more wire-bond, via, or other electrical connections, according to an example embodiment of the invention. Similarly, the second transformer 306 may include a primary multi-turn winding 303 (e.g., 2 or more turns) and a secondary multi-turn winding 304 (e.g., 2 or more turns), according to an example embodiment of the invention. The primary multi-turn winding 303 may include a plurality of inner and outer sections 303*a-c* that may be connected by one or more wire-bond, via, or other electrical connections, according to an example embodiment of the invention. The secondary multi-turn winding 304 may include a plurality of inner and outer sections 304*a-c* that may be connected by one or more wire-bond, via, or other electrical connections, according to an example embodiment of the invention.

According to an example embodiment of the invention, the spacing between the adjacent sections 301*b*, 303*a* of the primary multi-turn windings 301, 303 may be minimized to provide a compact layout. For example, the spacing between the adjacent sections 301*b*, 303*a* may be less than 50 μm, perhaps in the range of minimum spacing to 15 μm (e.g., perhaps 0.01-6 μm) for a highly compact layout or in the range of 15-30 μm (e.g., perhaps 12-14 μm) for a slightly less compact layout. Other spacing ranges may also be utilized without departing from example embodiments of the invention.

In FIG. 3, the multi-turn primary winding 301 may be provided with a first rotational current direction (e.g., counterclockwise) when the multi-turn primary winding 303 may be provided with a second rotational current direction (e.g., clockwise) that is opposite the first rotational direction. Accordingly, when the bottom section 301*b* of the multi-turn primary winding 301 may have a linear current flow direction (e.g., left to right) that may be the same as that for the top section 303*a* of the multi-turn primary winding 303. According to an example embodiment of the invention, the bottom section 301*b* and the top section 303*a* may be magnetically coupled to each other.

In order to provide the first multi-turn primary winding 301 with the first rotational current direction, the primary multi-turn winding 301 may receive input signals from a first input port 310 that receives a negative input signal and a second input port 311 that receives a positive input signal. The secondary multi-turn winding 302 may provide output signals at a first output port 320 providing a negative output signal and a second output port 321 providing a positive output signal, according to an example embodiment of the invention.

On the other hand, in order to provide the second multi-turn primary winding 303 with the second rotational current direction opposite the first rotational current direction, the primary multi-turn winding 303 may receive input signals from a first input port 312 that receives a positive input signal and a second input port 313 that receives a negative input signal. The secondary multi-turn winding 304 may provide output signals at a first output port 322 providing a positive output signal and a second output port 323 providing a negative output signal. It will be appreciated that the input ports and the output ports may be reassigned to various other locations without departing from example embodiments of the invention.

FIG. 4 illustrates the compact layout of FIG. 1A where the multiple transformers are provided with DC feeds through center tap ports, according to an example embodiment of the invention. As shown in FIG. 4, each primary winding 111, 113 may include a respective center tap port 401, 402. Likewise, each secondary winding 112, 114 may include a respective center tap port 403, 404. The center tap ports 401, 402, 403, 404 may be at virtual AC grounds when differential signals are provided to respective input ports 103, 104 and 105, 106. According to an example embodiment of the invention, one or more respective DC bias voltages 411-414 may be fed through the one or more respective center tap ports 401-404. According to an example embodiment of the invention, the positions of the center tap ports 401-404 may correspond to a middle or symmetrical position of the respective primary windings 111, 113 or secondary winding 112, 114. However, in another example embodiment of the invention, the positions of the center tap ports 401-404 may vary from a middle or symmetrical position as well.

FIG. 5 illustrates the example compact multiple transformers of FIG. 1A, where the multiple transformers may be provided with tuning blocks through center tap ports, according to an example embodiment of the invention. As shown in FIG. 5, each primary winding 111, 113 may include a respective center tap port 501, 502. Likewise, each secondary winding 112, 114 may include a respective center tap port 503, 504. The center tap ports 501, 502, 503, 504 may be at virtual AC grounds when differential signals are provided to respective input ports 103, 104 and 105, 106. According to an example embodiment of the invention, one or more tuning blocks 511, 512, 513, 514 may be provided to the respective windings 501-504 through respective center tap ports 501-504. According to an example embodiment of the invention, one or more tuning blocks 511-514 may be utilized to tune the frequency characteristics of the transformers 101, 102. For example, the tuning blocks 511-514 may be operative to control, adjust, filter, or otherwise tune the frequency bands of coupling, according to an example embodiment of the invention. As another example, the tuning blocks 511-514 may be resonant circuits that are operative to selectively enhance or suppress one or more frequency components, according to an example embodiment of the invention. According to an example embodiment of the invention, the tuning blocks 511-514 may have arbitrary complex impedances from 0 to infinity for one or more frequency bands.

FIG. 6A is a schematic diagram of an example tuning block, according to an example embodiment of the invention. As shown in FIG. 6A, the tuning block may be a resonant circuit comprised of a capacitive component 601 and an inductive component 602 connected in series, according to an example embodiment of the invention. The port 600 of the resonant circuit may be connected to a center tap port of a primary and/or a secondary winding, according to an example embodiment of the invention. The resonant circuit of FIG. 6A may have an associated resonant frequency fn 603, according to an example embodiment of the invention.

FIG. 6B illustrates another schematic diagram of an example tuning block, according to an example embodiment of the invention. As shown in FIG. 6B, the tuning block may be a resonant circuit comprised of a capacitive component 611 in parallel with an inductive component 612. The port 610 of the resonant circuit may be connected to a center tap port of a primary and/or a secondary winding, according to an example embodiment of the invention. The resonant circuit may have a resonant frequency fn 613, according to an example embodiment of the invention.

FIG. 6C illustrates another schematic diagram of an example tuning block, according to an example embodiment of the invention. As shown in FIG. 6C, there may be a resonant circuit having a plurality of resonant frequencies such as resonant frequencies fn1 627, fn2 628, and fn3 629. For example, capacitive component 621 and inductive component 622 may be connected in series to provide resonant frequency fn1 627. Likewise, capacitive component 623 may be connected in series to inductive component 624 to provide resonant frequency fn2 628. Additionally, capacitive component 625 may be connected in series with inductive component 626 to provide resonant frequency fn3 629. The port 620 of the resonant circuit may be connected to a center tap port of a primary and/or a secondary winding, according to an example embodiment of the invention. It will be appreciated that while FIG. 6C illustrates a particular configuration for a resonant circuit, other embodiments of the invention may include varying types of series/parallel resonant circuits without departing from example embodiments of the invention. Furthermore, while the tuning blocks are illustrated as being connected at the center tap ports, other embodiments of the invention may connect the tuning blocks to the primary windings in other locations as well.

It will be appreciated that the values and parameters of the capacitive and inductive components of FIGS. 6A-6C may be selected to have one or more desired resonant frequencies. Furthermore, the resonant circuits may also include resistive components as well. According to an example embodiment of the invention, the one or more resonant frequencies of the tuning block may be operative to filter undesirable harmonics or enhance other harmonics at the one or more resonant frequencies, thereby controlling the frequencies of coupling.

According to an example embodiment of the invention, the layouts for the transformers described herein may be implemented utilizing a planar structure or a stacked structure. With a planar structure, the plurality of transformers may be placed substantially in the same metal layer. For example, as shown in the example planar substrate structure of FIG. 7, the plurality of transformers may all be fabricated on the same first metal layer 702. Routing between input and output ports or between sections of the primary/secondary winding may be accomplished using one or more via, wire-bond, or other electrical connections, according to an example embodiment of the invention.

According to another example embodiment of the invention, the layouts for the transformers may also be implemented utilizing a stacked structure. For example, in the stacked substrate structure of FIG. 8, a first transformer may be formed on metal layer 802 while a second transformer may be formed on metal layer 804, according to an example embodiment of the invention. Routing between input and output ports or between sections of the primary/secondary winding may be accomplished using one or more via, wire-bond, or other electrical connections, according to an example embodiment of the invention.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A system for multiple transformers, comprising:

a first transformer that includes a first primary winding and a first secondary winding, wherein the first primary winding encapsulates the first secondary winding, wherein the first primary winding is inductively coupled to the first secondary winding, wherein the first transformer is associated with a first rotational current flow direction in the first primary winding; and a second transformer that includes a second primary winding and a second secondary winding, wherein the second primary winding encapsulates the second secondary winding, wherein the second primary winding is inductively coupled to the second secondary winding, wherein the second transformer is associated with a second rotational current flow direction opposite the first rotational current flow direction in the second primary winding, wherein a first section of the first primary winding is positioned adjacent to a second section of the second primary winding, wherein the adjacent first and second sections include a substantially same first linear current flow direction, wherein one or more of the first primary winding, first secondary winding, second primary winding, or second secondary winding include a respective center tap port, wherein one or more of the respective center tap ports are connected to respective tuning blocks to adjust frequency characteristics of the first transformer or the second transformer, the respective tuning blocks comprising a respective combination of at least one inductor and at least one capacitor.

2. The system of claim 1, wherein the first rotational current flow direction and the second rotational current flow direction are chosen from the group consisting of (i) a clockwise current flow direction and (ii) a counterclockwise current flow direction.

3. The system of claim 1, wherein the first section of the first primary winding and the second section of the second primary winding are magnetically coupled to each other.

4. The system of claim 1, further comprising:

a third transformer that includes a third primary winding and a third secondary winding, wherein the third primary winding is inductively coupled to the third secondary winding, wherein the third transformer is associated with the first rotational current flow direction in the third primary winding, wherein a third section of the third primary winding is positioned adjacent to a fourth section of the second primary winding, wherein the adjacent third and fourth sections include a substantially same second linear current flow direction opposite the first linear current flow direction.

5. The system of claim 1, wherein the transformers are spiral-type transformers.

6. The system of claim 1, wherein a separation distance between the adjacent first and second sections is in a range of 0.01 μm to 30 μm.

7. The system of claim 1, wherein the first and second transformers are operative for inter-stage matching.

8. The system of claim 1, wherein the first primary winding, the first secondary winding, the second primary winding, and the second secondary winding each include one or more turns.

9. The system of claim 1, wherein the first transformer and the second transformer are substantially symmetrical in structure.

10. The system claim 1, wherein each of the center tap ports defines a virtual ground.

11. The system of claim 10, wherein one or more of the center tap ports are operative to receive bias voltages for the respective first or second transformers.

12. The system of claim 1, wherein each respective combination of at least one inductor and at least one capacitor forms a respective resonant circuit for enhancing or suppressing one or more frequency components.

13. The system of claim 1, wherein the first and second transformers are fabricated (i) on a single metal layer according to a planar structure, or (ii) on two or more metal layers according to a stacked structure.

14. The system of claim 1, wherein one or more of the first primary winding, first secondary winding, second primary winding, and second secondary winding include via connections or wire-bond connections to avoid overlapping each other.

15. A method for providing multiple transformers, comprising:

providing a first transformer that includes a first primary winding and a first secondary winding, wherein the first primary winding encapsulates the first secondary winding, wherein the first primary winding is inductively coupled to the first secondary winding, wherein the first primary winding is coupled to first input ports;

receiving a first input source at the first input ports to provide a first rotational current flow direction in the first primary winding;

providing a second transformer that includes a second primary winding and a second secondary winding, wherein the second primary winding encapsulates the second secondary winding, wherein the second primary winding is inductively coupled to the second secondary winding, wherein the second primary winding is coupled to second input ports;

receiving a second input source at the second input ports to provide a second rotational current flow direction opposite the first rotational current flow direction in the second primary winding; and positioning a first section of the first primary winding adjacent to a second section of the second primary winding, wherein the adjacent first and second sections include a substantially same linear current flow direction, wherein one or more of the first primary winding, first secondary winding, second primary winding, or second secondary winding include a respective center tap port, wherein one or more of the respective center tap ports are connected to respective tuning blocks to adjust frequency characteristics of the first transformer or the second transformer, the respective tuning blocks comprising a respective combination of at least one inductor and at least one capacitor.

16. The method of claim 15, wherein the first rotational current flow direction and the second rotational current flow direction are chosen from the group consisting of (i) a clockwise current flow direction and (ii) a counterclockwise current flow direction.

17. The method of claim 15, wherein the first transformer and the second transformer are substantially symmetrical in structure.

18. The method of claim 15, wherein each of the center tap ports defines a virtual ground.

19. The method of claim 15, wherein the transformers are spiral-type transformers.

20. The method of claim 15, wherein each respective combination of at least one inductor and at least one capacitor forms a respective resonant circuit for enhancing or suppressing one or more frequency components.

* * * * *